US008328017B2

(12) United States Patent
Perell

(10) Patent No.: US 8,328,017 B2
(45) Date of Patent: Dec. 11, 2012

(54) USER INFLATED BREACHABLE CONTAINER, AND METHOD

(75) Inventor: William S. Perell, San Francisco, CA (US)

(73) Assignee: PopPack, LLC, San Francisco, CA (US)

( * ) Notice: Subject to any disclaimer, the term of this patent is extended or adjusted under 35 U.S.C. 154(b) by 1237 days.

(21) Appl. No.: 11/731,703

(22) Filed: Apr. 2, 2007

(65) Prior Publication Data

US 2007/0237431 A1 Oct. 11, 2007

Related U.S. Application Data

(60) Provisional application No. 60/790,863, filed on Apr. 11, 2006.

(51) Int. Cl.
*B65D 33/00* (2006.01)

(52) U.S. Cl. ..... 206/484; 383/3; 383/210

(58) Field of Classification Search ..... 206/522, 206/484, 219, 221; 383/3, 210, 211
See application file for complete search history.

(56) References Cited

U.S. PATENT DOCUMENTS

| | | | | |
|---|---|---|---|---|
| 3,074,544 | A | 1/1963 | Bollmeier et al. | |
| 3,189,227 | A | 6/1965 | Hobbs et al. | |
| 3,256,981 | A | 6/1966 | Kurtz | |
| 3,294,227 | A | 12/1966 | Schneider et al. | |
| 3,301,390 | A | 1/1967 | Via, Jr. | |
| 3,573,069 | A | 3/1971 | Keller et al. | |
| 3,608,709 | A | 9/1971 | Pike | |
| 3,635,376 | A | 1/1972 | Hellstrom | |
| 3,921,805 | A | 11/1975 | Compere | |
| 4,198,972 | A * | 4/1980 | Herb | 604/408 |
| 4,275,840 | A | 6/1981 | Staar | |
| 4,301,923 | A | 11/1981 | Vuorento | |
| 4,402,402 | A | 9/1983 | Pike | |
| 4,467,588 | A * | 8/1984 | Carveth | 206/219 |
| 4,511,052 | A | 4/1985 | Klein et al. | |

(Continued)

FOREIGN PATENT DOCUMENTS

DE 20314741 1/2004

(Continued)

OTHER PUBLICATIONS

International Search Report, Oct. 9, 2007.

*Primary Examiner* — Andrew Perreault
(74) *Attorney, Agent, or Firm* — Dority & Manning, P.A.

(57) ABSTRACT

Breachable product container 10 is formed by first lamina 10B and opposed second lamina 10C selectively pressed together. Perimeter seal 10S extends around the perimeter of the container. Product chamber 12P and inflatable breaching bubble 12 are between the selectively pressed opposed laminae, within the perimeter seal. Product 16 is contained within the product chamber. Inner divider 14D extends between the product chamber and the breaching bubble. Transfer passage 14 through the inner divider permits inflation of the breaching bubble in response to moderate pressure applied to the product chamber during an extended inflation period. Breaching edge 12E forms part of the perimeter seal around the breaching bubble. The breaching edge provides an edge breach by separating the opposed laminae along the breaching edge in response to substantial pressure applied to the breaching bubble during a brief breaching period. Opposed peel flaps 12C and 12B are formed along the edge breach by the separated opposed laminae. The end-user pulls the peel flaps apart causing detachment of the inner divider for permitting access to the product chamber.

18 Claims, 3 Drawing Sheets

U.S. PATENT DOCUMENTS

| | | | | | |
|---|---|---|---|---|---|
| D279,808 | S | | 7/1985 | Pharo | |
| 4,540,089 | A | | 9/1985 | Maloney | |
| 4,597,244 | A | | 7/1986 | Pharo | |
| 4,608,043 | A | * | 8/1986 | Larkin | 206/219 |
| 4,610,684 | A | | 9/1986 | Knox et al. | |
| 4,632,244 | A | | 12/1986 | Landau | |
| 4,704,314 | A | | 11/1987 | Hsu et al. | |
| 4,711,359 | A | | 12/1987 | White et al. | |
| 4,759,472 | A | | 7/1988 | Strenger | |
| 4,793,123 | A | | 12/1988 | Pharo | |
| 4,798,288 | A | | 1/1989 | Holzner | |
| 4,872,556 | A | | 10/1989 | Farmer | |
| 4,872,558 | A | | 10/1989 | Pharo | |
| 4,874,093 | A | | 10/1989 | Pharo | |
| 4,890,744 | A | | 1/1990 | Lane, Jr. et al. | |
| 4,918,904 | A | | 4/1990 | Pharo | |
| 4,949,530 | A | | 8/1990 | Pharo | |
| 4,952,068 | A | * | 8/1990 | Flint | 206/219 |
| 4,961,495 | A | | 10/1990 | Yoshida et al. | |
| 5,050,736 | A | | 9/1991 | Griesbach | |
| 5,100,028 | A | | 3/1992 | Seifert | |
| 5,114,004 | A | | 5/1992 | Isono et al. | |
| 5,126,070 | A | | 6/1992 | Leifheit et al. | |
| 5,207,320 | A | | 5/1993 | Allen | |
| 5,215,221 | A | | 6/1993 | Dirksing | |
| 5,272,856 | A | | 12/1993 | Pharo | |
| 5,325,968 | A | | 7/1994 | Sowden | |
| 5,373,966 | A | | 12/1994 | O'Reilly et al. | |
| 5,423,421 | A | * | 6/1995 | Inoue et al. | 206/219 |
| 5,427,830 | A | | 6/1995 | Pharo | |
| 5,431,496 | A | * | 7/1995 | Balteau et al. | 206/219 |
| 5,445,274 | A | | 8/1995 | Pharo | |
| 5,447,235 | A | | 9/1995 | Pharo | |
| 5,487,470 | A | | 1/1996 | Pharo | |
| 5,492,219 | A | | 2/1996 | Stupar | |
| 5,588,532 | A | | 12/1996 | Pharo | |
| D386,074 | S | | 11/1997 | Pharo | |
| 5,711,691 | A | | 1/1998 | Damask et al. | |
| 5,775,491 | A | | 7/1998 | Taniyama | |
| 5,792,213 | A | | 8/1998 | Bowen | |
| 5,814,159 | A | | 9/1998 | Paley et al. | |
| 5,865,309 | A | | 2/1999 | Futagawa et al. | |
| 5,870,884 | A | | 2/1999 | Pike | |
| 5,910,138 | A | | 6/1999 | Sperko et al. | |
| 5,928,213 | A | | 7/1999 | Barney et al. | |
| 5,944,709 | A | | 8/1999 | Barney et al. | |
| 5,967,308 | A | | 10/1999 | Bowen | |
| 6,001,187 | A | | 12/1999 | Paley et al. | |
| 6,007,264 | A | | 12/1999 | Koptis | |
| 6,036,004 | A | | 3/2000 | Bowen | |
| 6,068,820 | A | | 5/2000 | De Guzman | |
| 6,165,161 | A | | 12/2000 | York et al. | |
| 6,198,106 | B1 | | 3/2001 | Barney et al. | |
| 6,203,535 | B1 | | 3/2001 | Barney et al. | |
| 6,231,559 | B1 | * | 5/2001 | Loretti | 604/410 |
| 6,468,377 | B1 | | 10/2002 | Sperko et al. | |
| 6,491,159 | B2 | | 12/2002 | Shibata | |
| 6,547,468 | B2 | | 4/2003 | Gruenbacher et al. | |
| 6,726,364 | B2 | | 4/2004 | Perell | |
| 6,846,305 | B2 | | 1/2005 | Smith et al. | |
| 6,935,492 | B1 | | 8/2005 | Loeb | |
| 6,968,952 | B2 | | 11/2005 | Crevier et al. | |
| 6,996,951 | B2 | | 2/2006 | Smith et al. | |
| 7,051,879 | B2 | | 5/2006 | Ramet | |
| 7,055,683 | B2 | | 6/2006 | Bourque et al. | |
| 7,175,614 | B2 | | 2/2007 | Gollier et al. | |
| 7,306,095 | B1 | | 12/2007 | Bourque et al. | |
| 2002/0150658 | A1 | | 10/2002 | Morrissette et al. | |
| 2002/0170832 | A1 | | 11/2002 | Klair | |
| 2003/0019781 | A1 | | 1/2003 | Kocher | |
| 2004/0057638 | A1 | | 3/2004 | Perell et al. | |
| 2004/0226848 | A1 | | 11/2004 | Dunn-Rankin | |
| 2005/0006404 | A1 | | 1/2005 | Harper | |
| 2006/0023976 | A1 | | 2/2006 | Alvater et al. | |
| 2006/0126970 | A1 | | 6/2006 | Perell | |

FOREIGN PATENT DOCUMENTS

| | | | |
|---|---|---|---|
| EP | 00306207 | A1 | 3/1989 |
| EP | 00317130 | A1 | 5/1989 |
| FR | 2345363 | A1 | 10/1977 |
| GB | 2253605 | A | 9/1992 |
| JP | 04215927 | A | 8/1992 |
| JP | 11029176 | A | 2/1999 |
| JP | 2000255598 | A | 9/2000 |
| WO | WO 96/23700 | A1 | 8/1996 |
| WO | WO 02/083504 | A1 | 10/2002 |
| WO | WO 2004/100856 | A2 | 11/2004 |
| WO | WO 2005/022323 | A | 3/2005 |
| WO | WO 2005/077811 | A1 | 8/2005 |

* cited by examiner

METHOD STEPS

USER INFLATED BREACHABLE CONTAINER, AND METHOD

This application claims the benefit of provisional application Ser. No. 60/790,863, filed Apr. 11, 2006.

TECHNICAL FIELD

This invention relates to breachable product containers, and more particularly to such a container that is inflated by the user just prior to opening.

BACKGROUND

U.S. Pat. No. 6,726,364 issued on Apr. 27, 2004 to the present inventor teaches a breaching bubble with opposed peel flaps along the breaching edge. The peel flaps are pulled back by the consumer to open a chamber and present a stored product. However, this earlier bubble is not inflated by the user. The subject matter of U.S. Pat. No. 6,726,364 is hereby incorporated by reference in its entirety into this disclosure.

U.S. Pat. No. 4,872,556 to Farmer teaches a container with two rupturing seals for controlling the discharge of a stored liquid or fluid commodity. The commodity is contained in a large storage chamber and dispensed through a smaller, adjacent discharge chamber. Pressure applied to the commodity in the storage chamber causes an inner storage seal between the two chambers to rupture, resulting in fluid flow from the storage chamber into the discharge chamber. Continued pressure on the storage chamber fluid causes an outer discharge seal to rupture permitting the fluid to discharge from the discharge chamber into the ambient. Major consumer pressure was required to rupture both the storage seal and the discharge seal. Farmer does not provide a passage through the storage seal from the storage chamber to the discharge chamber.

SUMMARY

It is therefore an object of this invention to provide a breachable container which may be stored and shipped and handled partially or completed deflated. The containers with deflated product chambers and breaching bubbles requires minimal storage space and shipping volume, and undergoes minimal loss through accidental "poppage". Fully inflated containers may be subjected to the weight of other containers or to "rough" handling. Poppage, or breach during commerce exposes the product to the ambient.

It is another object of this invention to provide such a container in which a breaching bubble is inflated to breaching condition by the end-user just prior to opening. The user presses on the product chamber to transfer inflation fluid through a transfer passage into the breaching bubble. The breaching bubble inflates to breaching condition. The breaching bubble becomes sufficiently "plump" so as to be edge breached by sharply applied user pressure.

It is a further object of this invention to provide such a container in which the product chamber and the breaching bubble are in fluid equilibrium during storage and shipping. The inflation fluid may freely transfer forward into the breaching bubble and backward into the product chamber.

It is a further object of this invention to provide such a container in which the flow of inflation fluid is controlled. A one-way valve in the transfer passage prevents backward flow. Only forward flow is permitted during storage and shipping.

Briefly, these and other objects of the present invention are accomplished by providing a first lamina and an opposed second lamina selectively pressed together. A perimeter seal around the container formed by the selective pressing. A product chamber and an inflatable breaching bubble between the selectively pressed opposed laminae, within the perimeter seal. An inner divider extends between the product chamber and the breaching bubble, and is formed by the selective pressing. A transfer passage through the inner divider permits inflation of the breaching bubble in response to moderate pressure applied to the product chamber during an extended inflation period. A breaching edge forms part of the perimeter seal around the breaching bubble. The breaching edge providing an edge breach by separating the opposed laminae along the breaching edge in response to substantial pressure applied to the breaching bubble during a brief breaching period.

BRIEF DESCRIPTION OF THE DRAWINGS

Further objects and advantages of the user inflated breaching bubble and the operation of the transfer passage will become apparent from the following detailed description and drawings (not drawn to scale) and flow chart in which.

Figure 1A:
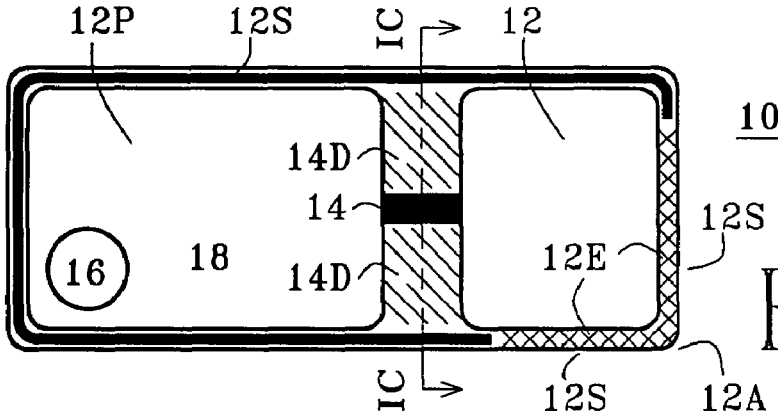
FIG. 1A is a plan view of breachable product container 10 showing product chamber 12P and breaching bubble 12 with transfer passage 14 therebetween.

The first digit of each reference numeral in the above figures indicates the figure in which an element or feature is most prominently shown. The second digit indicates related elements or features, and a final letter (when used) indicates a sub-portion of an element or feature.

REFERENCE NUMERALS IN DRAWINGS

The table below lists the reference numerals employed in the figures, and identifies the element designated by each numeral.

| | |
|---|---|
| Breachable Product Container | 10 |
| First Lamina | 10B |
| Second Lamina | 10C |
| Perimeter Seal | 10S |
| Breaching Bubble | 12 |
| Corner Apex | 12A |
| Opposed Peel Flap | 12B |
| Opposed Peel Flap | 12C |
| Breaching Edge | 12E |
| Product Chamber | 12P |
| Corner Sides | 12S |
| Transfer Passage | 14 |
| Divider | 14D |
| Product | 16 |
| Inflation Fluid | 18 |
| Breachable Product Container | 20 |
| Breaching Bubble | 22 |
| Header Space | 22H |
| Product Chamber | 22P |
| Transfer Passage | 24 |
| Particle Product | 26 |
| Inflation Fluid | 28 |
| Header Portion | 28H |
| Interstitial Portion | 28I |
| Breachable Product Container | 30 |
| Receiving Portal | 30P |
| Perimeter Seal | 30S |
| Product Chamber | 32P |
| Transfer Passage | 34 |
| Product | 36 |
| Inflation Fluid | 38 |
| Breachable Product Container | 40 |
| Breaching Bubble | 42 |
| Product Chamber | 42P |
| Transfer Passage | 44 |
| Relief Course | 44R |
| Flapper Valve | 44V |
| Breachable Product Container | 50 |
| Breaching Bubble | 52 |
| Product Chamber | 52P |
| Transfer Passage | 54 |
| Inner Divider | 54D |
| Relief Course | 54R |
| Resilient Valve | 54V |

GENERAL EMBODIMENT—(FIGS. 1 ABCDEF)

Figure 1B:
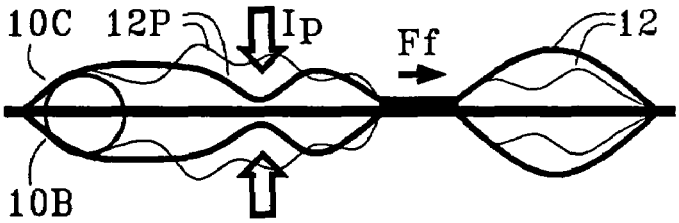
FIG. 1B is a side view of container 10 of FIG. 1A showing product chamber 12P and breaching bubble 12 before inflation (light lines) and during inflation (bold lines)
Figure 1C:
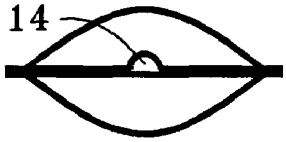
FIG. 1C is an end view in section of container 10 of FIG. 1 taken generally along reference line IC-IC thereof showing transfer passage 14.

Breachable product container 10 is formed by first lamina 10B and opposed second lamina 10C selectively pressed together (see FIG. 1B). Perimeter seal 10S (indicated by a solid bold line in FIG. 1A) extends around the perimeter of the container, and is formed by the selective pressing. Product chamber 12P and inflatable breaching bubble 12 are between the selectively pressed opposed laminae, within the perimeter seal. Product 16 is contained within the product chamber. Inner divider 14D (indicated by single hatched lines), extends between the product chamber and the breaching bubble, and is formed by the selective pressing. Transfer passage 14 (indicated by a wide bold line), through the inner divider permits inflation of the breaching bubble in response to moderate pressure applied to the product chamber during an extended inflation period. Breaching edge 12E (indicated by double hatched lines) forms part of the perimeter seal around the breaching bubble. The breaching edge provides an edge breach by separating the opposed laminae along the breaching edge in response to substantial pressure applied to the breaching bubble during a brief breaching period.

Opposed peel flaps 12C and 12B (see FIG. 1F) are formed along the edge breach by the separated opposed laminae. The end-user pulls the peel flaps apart causing detachment of the inner divider for permitting access to the product chamber. Breaching bubble 12 has a corner with corner apex 12A and two adjacent corner sides 12S (see FIG. 1A). Breaching edge 12E starts at the apex, which is the focus of the separation, and extends along both adjacent sides. The opposed peel flaps are formed by the opposed laminae at the corner and are generally triangular in shape for easy gripping by the end-user. Inflation fluid 18 within the product chamber is transferred through the transfer passage to inflate the breaching bubble during the extended inflation period. The inflation fluid may be ordinary ambient air, or a suitable special purpose fluid such as dry air, or an inert gas such as nitrogen.

The opposed laminae may have multiple layers to provide properties such as waterproofing, UV protection, increased bulk, and strength. The opposed laminae may be any suitable enclosing material such as plastic, paper fabric, cellophane, or bio-degradable matter. Thin mylar plastic is a flexible film with hermetic properties, and may be employed as a container material. The perimeter of the container has a breaching seal along the breaching edge for product access, and a non-breaching seal along the remaining perimeter. The breaching seal may be a frangible laminae union and the non-breaching seal may be a destructive laminae union. The frangible breaching seal is formed at a lower lamina-to-lamina pressure and a lower temperature for a shorter time than the destructive non-breaching seal. The frangible seal is weaker than the destructive seal, and breaches at a lower separation force and requires less compressive pressure applied by the end-user during the breaching period.

GENERAL OPENING SEQUENCE—(FIG. 1D)

Figure 1D:
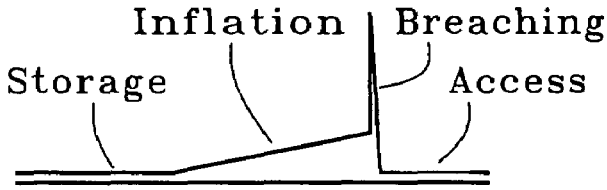
FIG. 1D is a graph depicting the pressure within breaching bubble 12 during Storage, Inflation, Breaching, and Access periods of the opening sequence.

The pressure within the breaching bubble during each period of the opening sequence is graphically depicted in FIG. 1D. During an indefinite storage period (warehousing, shipping, and shelf display), the breaching bubble typically experiences little or no pressure. During storage, the product chamber and the breaching bubble may be partially inflated and flaccid (see FIG. 1B light lines) or completely deflated and pressed flat (see FIG. 3B). During an extended inflation period, the end-user applies moderate pressure to the product chamber (indicated by opposed arrows labeled Ip in FIG. 1B). The pressure restricts the envelope of the product chamber, causing the product chamber to "plump-up" and become firm (see FIG. 1B, bold lines). Inflation fluid is forced from the taut product chamber, through the transfer passage, into the breaching bubble. The pressure within the breaching bubble "ramps-up" during the inflation period, causing the reaching bubble to also "plump-up".

Figure 1E:
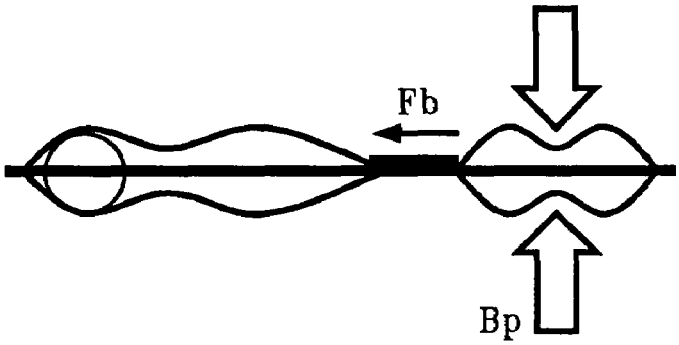
FIG. 1E is a side view of container 10 of FIG. 1A during the breaching period.

During a brief breaching period, the end-user applies substantial pressure sharply to the breaching bubble (indicated by opposed arrows Bp in FIG. 1E). The pressure in the breaching bubble rises to the breaching level, separating the opposed laminae along the breaching edge. The expanding bubble breaches into the ambient forming an edge breach. During an access period, the breached bubble is exposed to the ambient, at neutral pressure. The inflation fluid is lost and the container becomes flaccid. The inflation period should last only a moment or so, and the brief breaching period is shorter, perhaps less then a second. The method steps for the opening the product container are described in connection with FIG. 6.

EQUILIBRIUM EMBODIMENTS—(FIGS. 2 3AB)

The transfer passage in the equilibrium embodiments, is an open channel with free flowing inflation fluid. The product chamber and breaching bubble are in fluid communication through the transfer passage during the indefinite storage period and the extended inflation period and the brief breaching period. The inflation fluid in the product chamber and the breaching bubble is in a state of fluid equilibrium maintained by migration of inflation fluid forward and backward through the unobstructed transfer passage. In the equilibrium embodiment of FIG. 2, open channel transfer passage 24 is sufficiently narrow to restrain backward flow of inflation fluid 28 from of breaching bubble 22 into product chamber 22P under the substantial pressure applied during the brief breaching period.

During the extended inflation period, the moderate user pressure produces a slow forward inflation transfer. During the brief breaching period, the substantial user pressure produces a higher backward leakage transfer. The backward transfer flow rate (indicated by arrow Fb in FIG. 1E) may be higher than the forward transfer flow rate (indicated by arrow Ff in FIG. 1B) because the substantial breaching pressure is higher than the moderate inflation pressure. However, the total volume of the backward flow (Volume B=Fb×brief time) is far less than the volume of the forward flow (Volume F=Ff×extended time), because the brief breaching period is much shorter than the extended inflation period.

Figure 2:
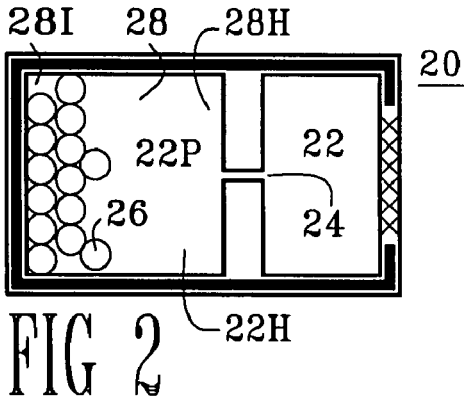
FIG. 2 is a plan view of breachable product container 20 showing product chamber 22P and breaching bubble 22 with transfer passage 24 therebetween.

The product chamber has a header space adjacent to the inner divider, which holds the inflation fluid prior to transfer through the transfer passage into the breaching bubble. Preferably, the header space holds enough inflation fluid to plump the breaching bubble during the extended inflation period. The product may be in particle form with inflation fluid filling the space between the product particles. As the particles gravity settle into a more compact format through shipping and handling, the header space enlarges. In the embodiment of FIG. 2, inflation fluid 28 has an active header portion 28H in header space 22H for transfer into the breaching bubble. The inflation fluid also has a passive interstitial portion 28I distributed among product particles 26.

Figure 3A:
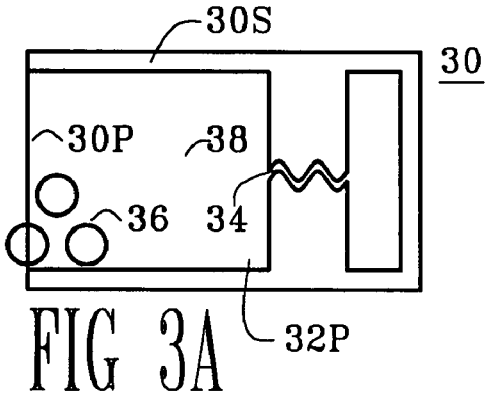
FIG. 3A is a plan view of breachable product container 30 showing tortuous transfer passage 34.
Figure 3B:
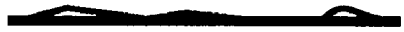
FIG. 3B is a side view of container 30 of FIG. 3A showing the container in a deflated condition.

In the embodiment of FIG. 3A, open channel transfer passage 34 is sufficiently tortuous with turns and curves to restrain backward flow of inflation fluid 38 during the brief breaching period. Receiving portal 30P through perimeter seal 30S around product chamber 32P receives inflation fluid 38 and product 36 into the product chamber. Prior to receiving, the empty deflated proto-containers may be easily shipped and handled. A perimeter seal may be pressed across the receiving portal, after receiving the inflation fluid into the product chamber and the breaching bubble, and the product into the product chamber.

CONTROLLED FLOW EMBODIMENTS—(FIGS. 4AB 5AB)

Figure 4A:
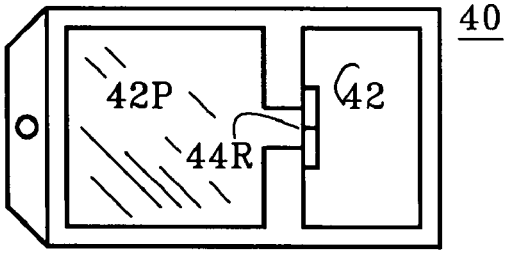
FIG. 4A is a plan view of breachable product container 40 showing closed flapper valve 44V preventing backward flow through transfer passage 44.
Figure 4B:
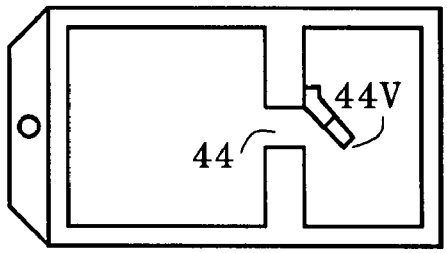
FIG. 4B is a side view of container 40 of FIG. 4A showing open flapper valve 44V permitting forward flow through transfer passage 44.

The transfer passage in the controlled flow embodiments has a one-way valve for controlling the inflation fluid flow. The product chamber and breaching bubble are in fluid communication through the transfer passage during the extended inflation period when the one-way valve is open. The fluid communication is blocked during the brief breaching period when the valve is closed. In the embodiment of FIG. 4, transfer valve 44V is a flapper valve positioned on the breaching bubble side of transfer passage 44. The flapper valve is open (see FIG. 4B) when the pressure in product chamber 42P is greater than the pressure in breaching bubble 42. The flapper valve is closed (see FIG. 4A) when the pressure in the product chamber is less than the pressure in the breaching bubble. The closed valve reduces leakage backward flow during the breaching period. Therefore the transfer passage may be wider without undue loss of breaching pressure during the breaching period.

Figure 5A:
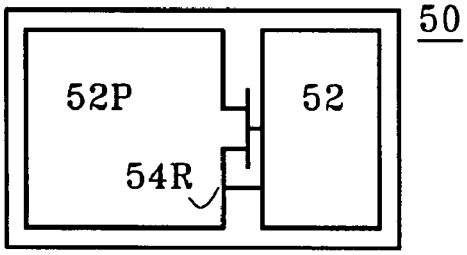
FIG. 5A is a plan view of breachable product container 50 showing closed resilient valve 54V preventing backward flow through transfer passage 54.
Figure 5B:
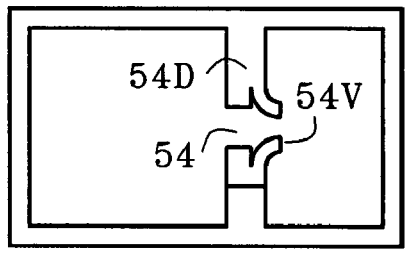
FIG. 5B is a side view of container 50 of FIG. 5A showing open resilient valve 54V permitting forward flow through transfer passage 54.

In the embodiment of FIG. 5A and FIG. 5B, transfer valve 54V is a resilient valve having an internal resilience urging the resilient valve toward closed. The resilient valve is open (see FIG. 5B) when the pressure in product chamber 52P is sufficient to overcome the pressure in breaching bubble 52 plus the internal resilience. The resilient valve is closed (see FIG. 5A) when the pressure in the product chamber is insufficient to overcome the pressure in the breaching bubble plus the internal resilience. The resilient is self-closing at the end of the inflation period.

The one-way valves may completely prevent backward flow and the release of pressure from the breaching bubble. As a consequence, the pressure in the breaching bubble may build-up monotonically. Pressure bleed-off or relief course 44R (see FIG. 4A) and 54R (see FIG. 5A) may extend between the breaching bubble and the product chamber. Relief course 44R extends through the flapper valve, and relief course 54R extends through inner divider 54D. These fine relief courses permit a minor bleed-off flow of inflation fluid to trickle from the breaching bubble back to the product chamber.

METHOD—(FIG. 6)

Figure 6:
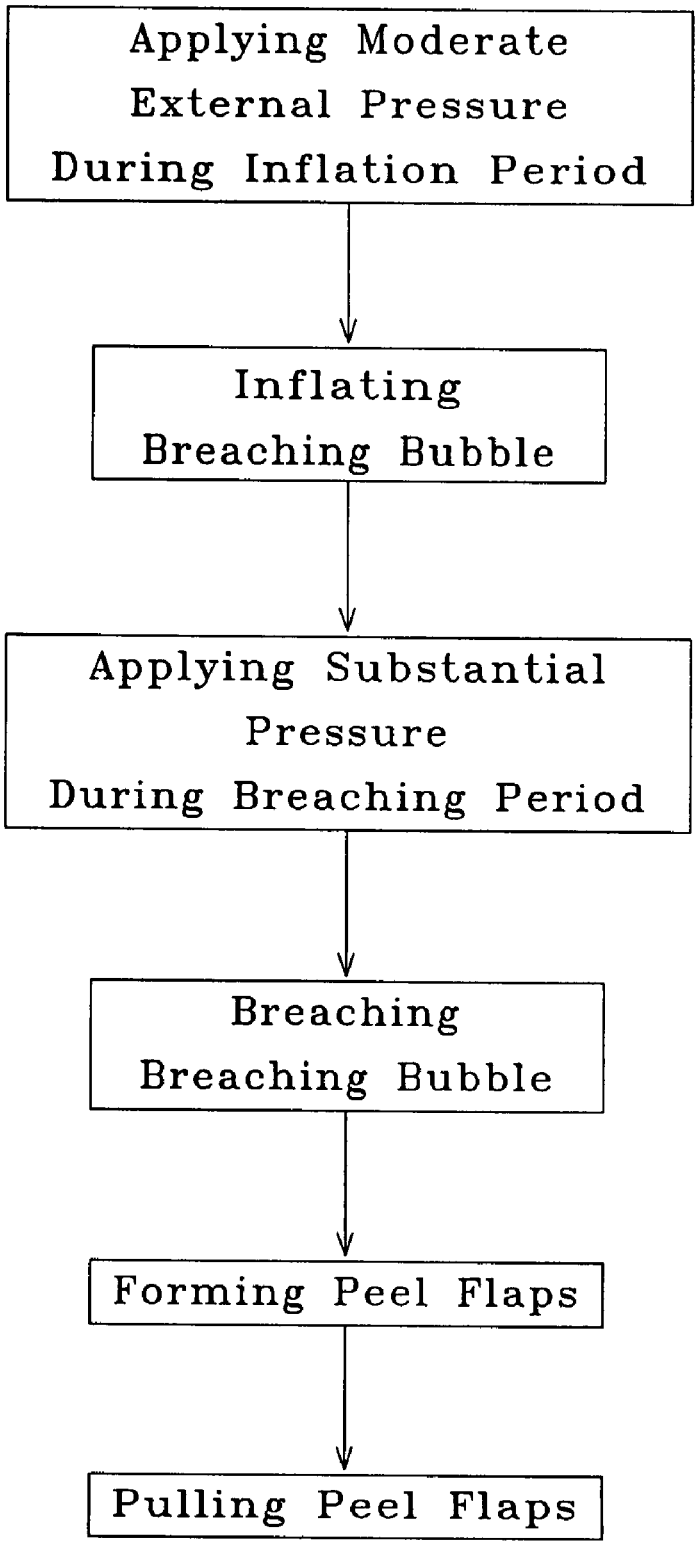
FIG. 6 is a flow chart showing the basic steps of the general method of gaining access to a product in a the container.

The steps of the general method of gaining access to a product in a container are shown in the flow chart of FIG. 6, and described below. The apparatus required for carrying out the above method of operation are disclosed in FIGS. 1-5 and in the related detailed descriptions. The container has a product chamber and a breaching bubble with an inner divider therebetween, formed by opposed laminae.

Applying moderate external pressure to the product chamber during an extended inflation period (see FIG. 1B).

Inflating the breaching bubble by transferring inflation fluid from the product chamber into the breaching bubble through a transfer passage in the inner divider (see FIG. 1B).

Applying substantial pressure to the breaching bubble during a brief breaching period (see FIG. 1E).

Figure 1F:
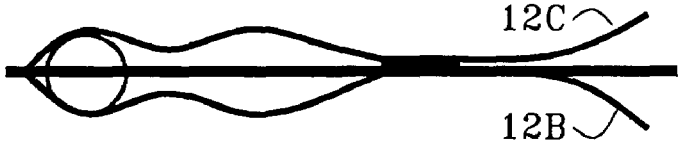
FIG. 1F is a side view of container 10 of FIG. 1A during the access period showing opposed peel flaps 12C and 12B.

Breaching the breaching bubble by separating the opposed lamina forming the breaching bubble (see FIG. 1F).

Forming peel flaps during the breaching step.

Pulling peel flaps apart to detach an inner divider between the product chamber and the breaching bubble.

INDUSTRIAL APPLICABILITY

It will be apparent to those skilled in the art that the objects of this invention have been achieved as described hereinbefore by providing a container which may be partially or completed deflated. Delated containers require have less volume, and less accidental "poppage". The deflated breaching bubble is inflated to breaching condition by the end-user by pressing on the product chamber. The product chamber and the breaching bubble may be in fluid equilibrium through a transfer passage. Alternatively, the flow of inflation fluid may be controlled by a one-way valve in the transfer passage.

Various changes may be made in the structure and embodiments shown herein without departing from the concept of the invention. Further, features of embodiments shown in various figures may be employed in combination with embodiments shown in other figures. Therefore, the scope of the invention is to be determined by the terminology of the following claims and the legal equivalents thereof.

I claim:

1. A container, comprising:

a product chamber located between a first lamina and an opposed second lamina, the product chamber containing a product and an inflation fluid;

an inflatable breaching bubble located between the opposed laminae;

an inner divider extending between the product chamber and the breaching bubble;

a transfer passage through the inner divider for permitting inflation of the breaching bubble by the inflation fluid in response to pressure applied to the product chamber during an inflation period;

a breaching edge forming part of a seal around the breaching bubble, for providing an edge breach by separating the opposed laminae along the breaching edge in response to pressure applied to the breaching bubble after the bubble has been inflated by the inflation fluid.

2. The container of claim 1, further comprising opposed peel flaps formed along the breaching edge by the separated opposed laminae, which permit detachment of the inner divider and access to the product chamber.

3. The container of claim 2, wherein:

the breaching bubble has a corner with an apex and two adjacent sides;

the breaching edge extends along the apex and both adjacent sides; and the opposed peel flaps are formed by the opposed laminae at the corner and are generally triangular in shape.

4. The container of claim 1, wherein the product chamber and the breaching bubble are deflated.

5. The container of claim 1, further comprising header space in the product chamber adjacent to the inner divider, for holding inflation fluid prior to transfer through the transfer passage into the breaching bubble.

6. The container of claim 5, wherein the header space holds enough inflation fluid to pump the breaching bubble during the inflation period.

7. The container of claim 5, wherein the product is in particle form, and the inflation fluid has a header portion in the header space for transfer into the breaching bubble, and an interstitial portion among the product particles.

8. The container of claim 1, wherein the product chamber and breaching bubble are;

in constant fluid communication through the transfer passage;

in a state of fluid equilibrium maintained by transfer of inflation fluid forward and backward through the transfer passage; and partially inflated.

9. The container of claim 8, wherein the transfer passage is sufficiently narrow to restrain backward flow of inflation fluid from the breaching bubble into the product chamber when pressure is applied to the bubble for providing an edge breach.

10. The container of claim 8, wherein the transfer passage is sufficiently tortuous to restrain backward flow of inflation fluid from the breaching bubble into the product chamber when pressure is applied to the bubble for providing an edge breach.

11. The container of claim 1, further comprising:

a one-way transfer valve for controlling the transfer of inflation fluid through the transfer passage and for preventing backward transfer of inflation fluid through the transfer passage from the breaching bubble to the product chamber when the bubble is breached.

12. The container of claim 11, further comprising a pressure bleed-off course from the breaching bubble to the product chamber for permitting bleed-off trickle flow of inflation fluid from the breaching bubble back to the product chamber.

13. The container of claim 11, wherein:

the transfer valve is a flapper valve positioned on the breaching bubble side of the transfer passage;

the flapper valve opens when the pressure in the product chamber is greater than the pressure in the breaching bubble; and the flapper valve closes when the pressure in the product chamber is less than the pressure in the breaching bubble.

14. The container of claim 11, wherein:

the transfer valve is a resilient valve having an internal resilience urging the resilient valve toward closed;

the resilient valve opens when the pressure in the product chamber is sufficient to overcome the pressure in the breaching bubble plus the internal resilience; and the resilient valve closes when the pressure in the product chamber is insufficient to overcome the pressure in the breaching bubble plus the internal resilience.

15. The container of claim 1, further comprising a receiving portal through a perimeter seal around the product chamber for receiving inflation fluid and product into the product chamber.

16. The container of claim 15, further comprising;

inflation fluid in the product chamber and the breaching bubble;

product in the product chamber; and a perimeter seal across the receiving portal.

17. A method of gaining access to a product in a container having a product chamber and a breaching bubble and an inner divider therebetween, formed by opposed laminae, comprising the steps of:

applying external pressure to the product chamber during an inflation period;

inflating the breaching bubble by transferring inflation fluid from the product chamber into the breaching bubble through a transfer passage in the inner divider;

applying pressure to the breaching bubble during a breaching period; and breaching the breaching bubble thereby separating the opposed lamina forming the breaching bubble.

18. The method of claim 17, comprising the additional steps of:

forming peel flaps during the breaching step; and pulling the peel flaps apart to detach an inner divider between the product chamber and the breaching bubble.

* * * * *